US005284732A

United States Patent [19]

Nii et al.

[11] Patent Number: 5,284,732

[45] Date of Patent: Feb. 8, 1994

[54] SILVER HALIDE PHOTOGRAPHIC MATERIAL

[75] Inventors: Kazumi Nii; Toshihide Ezoe, both of Kanagawa, Japan

[73] Assignee: Fuji Photo Film Co., Ltd., Ashigara, Japan

[21] Appl. No.: 73,571

[22] Filed: Jun. 9, 1993

[51] Int. Cl.[5] ..... G03C 1/06

[52] U.S. Cl. ..... 430/264; 430/598; 430/566; 430/487; 564/149; 564/151; 564/282; 564/291; 564/12

[58] Field of Search ..... 430/264, 598, 566, 487; 564/149, 151, 282, 291, 12

[56] References Cited

U.S. PATENT DOCUMENTS

| | | | |
|---|---|---|---|
| 4,383,948 | 5/1983 | Muller et al. | 564/149 |
| 4,824,774 | 4/1989 | Inoue et al. | 430/566 |
| 4,988,604 | 1/1991 | Machonkin et al. | 430/264 |
| 4,994,365 | 2/1991 | Looker et al. | 430/264 |
| 5,126,227 | 6/1992 | Machonkin et al. | 430/264 |
| 5,213,944 | 5/1993 | Adin | 430/264 |
| 5,229,248 | 7/1993 | Sanpei et al. | 430/264 |

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A silver halide light-sensitive material containing a hydrazine compound represented by formula (I):

(I)

wherein $L^1$ represents a single bond, —O—, —S—, —$NR^6$—, —CO—, $SO_2$—, —P(O) ($G^2R^6$)— or a combination thereof; $L^2$ represents —$SO_2NR^6$—, —$NR^6SO_2NR^6$—, —$CONR^6$—, —$NR^6CONR^6$— or —$G^2$P(O) ($G^2R^6$)$NR^6$—; $G^1$ represents —CO—, —$SO_2$—, —SO—, —COCO—, a thiocarbonyl group, an iminomethylene group or —P(O) ($G^2R^6$)—; $G^2$ represents a single bond, —O— or —$NR^6$—; $R^1$ represents an aliphatic group or an aromatic group; $R^2$, $R^3$, and $R^4$ each represent a divalent aliphatic group or a divalent aromatic group; $R^5$ represents a hydrogen atom, an aliphatic group, an aromatic group, an alkoxy group, an aryloxy group or an amino group; $R^6$ represents a hydrogen atom, an aliphatic group or an aromatic group; m represents 0 or 1; and $X^-$ represents a counter anion or a counter anion moiety of an intramolecular salt, as a nucleating agent. The light-sensitive material exhibits high processing stability even in rapid processing to provide a ultrahigh contrast negative image for photomechanical processing.

13 Claims, No Drawings

SILVER HALIDE PHOTOGRAPHIC MATERIAL

FIELD OF THE INVENTION

This invention relates to a silver halide photographic material and a method of forming a ultrahigh contrast negative image using the same. More particularly, it relates to a ultrahigh contrast negative silver halide photographic material suitable for use in photomechanical process.

BACKGROUND OF THE INVENTION

In the field of graphic arts, an image formation system providing ultrahigh contrast (especially a gamma exceeding 10) is required for achieving satisfactory reproduction of a dot image having continuous tone or a line image.

Image formation systems of using hydrazine derivatives have been proposed to obtain a high contrast image while using a stable developing solution as disclosed in U.S. Pat. Nos. 4,224,401, 4,168,977, 4,166,742, 4,311,781, 4,272,606, and 4,211,857. According to these systems, ultrahigh contrast and high sensitivity can be obtained. Further, since addition of a sulfite to a developing solution in a high concentration is permissive, stability of the developing solution against air oxidation can be greatly improved over lith developers. Nevertheless, hydrazine compounds which have been proposed to date turned out to have several disadvantages. That is, while it has been attempted to make the structure of hydrazine compounds non-diffusive for the purpose of minimizing adverse influences which may arise from the hydrazine compounds dissolved in a developing solution. These non-diffusive hydrazine compounds should be used in large quantities for sufficient sensitization and improvement in contrast so that they are apt to cause deterioration of physical properties of the developed light-sensitive layers or to precipitate in a coating composition. Further, when a light-sensitive material containing such a non-diffusive hydrazine compound fails to obtain sufficient high contrast when developed with a fatigued developing solution after use for processing a large volume of photographic materials.

In addition, a high contract system using the conventional hydrazine compound involves use of a developing solution having a relatively high pH, e.g., 12.0 or higher, which entails not only danger or handling but cost for waste liquid treatment due to high BOD or COD. Because a large amount of a pH buffer must be added to a developing solution for maintaining the pH constant, the developing solution is sticky due to the so increased solid content and is hardly wiped away when scattered.

It has therefore been demanded to develop a hydrazine compound which can achieve high contrast image formation while using a developing solution having a lower pH than in the systems using a conventional hydrazine derivative.

On the other hand, light-sensitive materials for dot-to-dot work which are generally handled in a bright room occupy a large proportion in the field of photomechanical processing. In this field, high reproducibility in formation of super-imposed letters even with a fine line width is demanded. To meet the demand, development of a nucleating agent having improved activity has been long awaited. The expectation for a nucleating agent with higher activity is particularly high for use in light-sensitive materials having low sensitivity so as to be handled in a bright room because they hardly undergo the activity of a nucleating agent.

SUMMARY OF THE INVENTION

An object of the present invention is to provide a silver halide photographic material for photomechanical processing which exhibits excellent stability in development processing and can be rapidly processed.

Another object of the present invention is to provide a silver halide photographic material for photomechanical processing which can be developed at a reduced pH.

The above objects of the present invention are accomplished by a silver halide light-sensitive material comprising a support and a silver halide emulsion layer and containing a compound represented by formula (I):

$$R^1-\overset{\overset{R^1}{|}}{\underset{\underset{R^1}{|}}{N}}{}^{\oplus}-R^2-L^1-(R^3-L^2)_m-R^4-NHNH-G^1-R^5 \quad (I)$$

$$X^-$$

wherein $L^1$ represents a single bond, —O—, —S—, —$NR^6$—, —CO—, $SO_2$—, —P(O) ($G^2R^6$)— or a combination thereof; $L^2$ represents —$SO_2NR^6$—, —$NR^6SO_2NR^6$—, —$CONR^6$—, —$NR^6CONR^6$— or —P(O) ($G^2R^6$)$NR^6$—; $G^1$ represents —CO—, —$SO_2$—, —SO—, —COCO—, a thiocarbonyl group, an iminomethylene group or —P(O) ($G^2R^6$)—; $G^2$ represents a single bond, —O— or —$NR^6$—; $R^1$ represents an aliphatic group or an aromatic group; $R^2$, $R^3$, and $R^4$ each represent a divalent aliphatic group or a divalent aromatic group; $R^5$ represents a hydrogen atom, an aliphatic group, an aromatic group, an alkoxy group, an aryloxy group or an amino group; $R^6$ represents a hydrogen atom, an aliphatic group or an aromatic group; m represents 0 or 1; and $X^-$ represents a counter anion or a counter anion moiety of an intramolecular salt.

DETAILED DESCRIPTION OF THE INVENTION

In formula (I), the aliphatic group as represented by $R^1$ preferably includes those having from 1 to 30 carbon atoms, and particularly a straight chain, branched or cyclic alkyl group having from 1 to 20 carbon atoms.

The aromatic group as represented by $R^1$ includes a monocyclic or bicyclic aryl group, or an unsaturated heterocyclic group which includes, for example, 5- or 6-membered rings containing at least one of N, S, and O and which may be condensed with an aryl group.

The aliphatic group or aromatic group for $R^1$ may be substituted typically with an alkyl group, an aralkyl group, an alkenyl group, an alkynyl group, an alkoxy group, an aryl group, a substituted amino group, a ureido group, a urethane group, a mercapto group, an aryloxy group, a sulfamoyl group, a carbamoyl group, an alkyl or arylthio group, an alkyl or arylsulfonyl group, an alkyl or arylsulfinyl group, a hydroxyl group, a halogen atom, a cyano group, a sulfo group, an aryloxycarbonyl group, an acyl group, an alkoxycarbonyl group, an acyloxy group, a carbonamido group, a sulfonamido group, a carboxyl group, a phosphoric acid amido group, a diacylamino group, an imido group, etc. Preferred of these substituents are an alkyl group (preferably having 1 to 20 carbon atoms), an aralkyl group (preferably having 7 to 30 carbon atoms), an alkoxy group (preferably having 1 to 20 carbon atoms), a substituted amino group (preferably an amino group substituted with an alkyl group having 1 to 20 carbon atoms), an acylamino group (preferably having 2 to 30 carbon atoms), a sulfonamido group (preferably having 1 to 30 carbon atoms), a ureido group (preferably having 1 to 30 carbon atoms), and a phosphoric acid amido group (preferably having 1 to 30 carbon atoms). These substituents may further be substituted.

The three $R^1$'s in formula (I) may be the same or different, or they may be linked together to form a ring.

The divalent aliphatic group as represented by $R^2$, $R^3$ or $R^4$ preferably include those containing from 1 to 30 carbon atoms, and more preferably a straight chain, branched or cyclic alkylene group having from 1 to 20 carbon atoms.

The divalent aromatic group as represented by $R^2$, $R^3$ or $R^4$ includes a monocyclic or bicyclic arylene group or an unsaturated divalent heterocyclic group which may be condensed with an aryl group.

$R^2$ preferably represents an alkylene group having from 1 to 10 carbon atoms, and $R^3$ and $R^4$ each preferably represent an arylene group, particularly a benzene ring-containing arylene group.

The aliphatic or aromatic group as $R^2$, $R^3$ or $R^4$ may be substituted. Typical substituents include those enumerated above as substituents for $R^1$.

$L^1$ represents a single bond, —O—, —S—, —$NR^6$—, —CO—, $SO_2$—, —P(O) ($G^2R^6$)— or a combination thereof, preferably —$SO_2NR^6$—, —$NR^6SO_2NR^6$—, —$CONR^6$—, —$NR^6CONR^6$— or —$G^2P(O)(G^2R^6)NR^6$—, and more preferably —$CONR^6$—.

$L^2$ preferably represents —$SO_2NR^6$—.

m represents 0 or 1, and preferably 1.

The aliphatic group as represented by $R^5$ is preferably an alkyl group having from 1 to 4 carbon atoms, and the aromatic group as represented by $R^5$ is preferably a monocyclic or bicyclic aryl group, e.g., a benzene ring-containing group.

Where $G^1$ is —CO—, $R^5$ preferably represents a hydrogen atom, an alkyl group (e.g., methyl, trifluoromethyl, 3-hydroxypropyl, 3-methanesulfonamidopropyl or phenylsulfonylmethyl), an aralkyl group (e.g., o-hydroxybenzyl), an aryl group (e.g., phenyl, 3,5-dichlorophenyl, o-methanesulfonamidophenyl, 4-methanesulfonylphenyl or 2-hydroxymethylphenyl), etc., with a hydrogen atom being particularly preferred.

$R^5$ may be substituted with, for example the substituents mentioned above for $R^1$.

$G^1$ is most preferably —CO—.

$R^5$ may be a group which makes the $G^1$—$R^5$ moiety be split off the rest of the molecule and induces a cyclization reaction to form a cyclic structure including the —$G^1$—$R^5$ moiety. Specific examples of such a group are described, e.g., in JP-A-63-29751 (the term "JP-A" as used herein means an "unexamined published Japanese patent application").

$R^6$ preferably represents a hydrogen atom or an alkyl group having from 1 to 6 carbon atoms, and most preferably a hydrogen atom. When there are two or more $R^6$'s or $G^2$'s per molecule, they may be the same or different.

$R^1$, $R^2$, $R^3$, $R^4$ or $R^5$ in formula (I) may contain therein a ballast group or a polymer which are generally employed in immobile photographically useful additives, such as couplers. The ballast group is an organic group which contains at least 8 carbon atoms and is relatively inert to photographic properties. Usable ballast groups include an alkyl group, an alkoxy group, a phenyl group, an alkylphenyl group, an phenoxy group, and an alkylphenoxy group. The polymer which may be incorporated includes those described in JP-A-1-100530.

$R^1$, $R^2$, $R^3$, $R^4$ or $R^5$ in formula (I) may further contain therein a group which accelerates adsorption onto silver halide grains. Suitable adsorption accelerating groups include a thiourea group, a heterocyclic thioamido group, a heterocyclic mercapto group, a triazole group. Specific examples of these groups are described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246.

Specific examples of the hydrazine compound (I) which can be used in the present invention are shown below for illustrative purposes only but not for limitation.

1

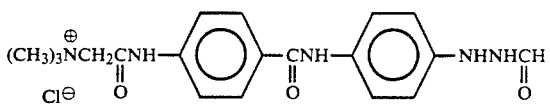

2

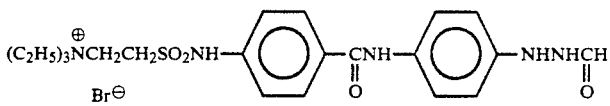

3

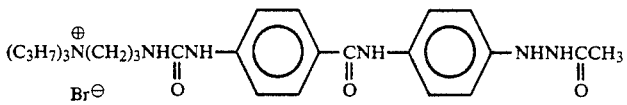

4

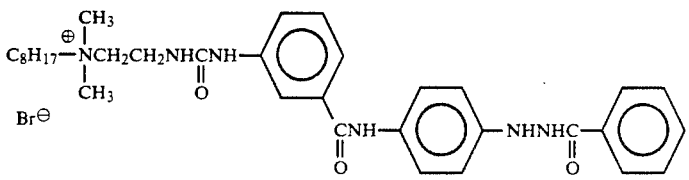

-continued
5
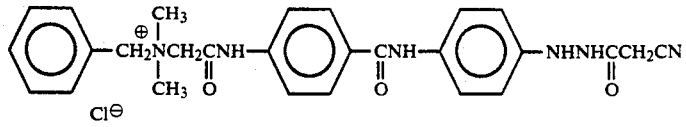
6
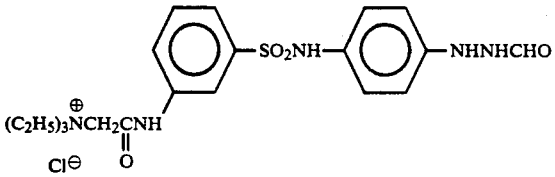
7
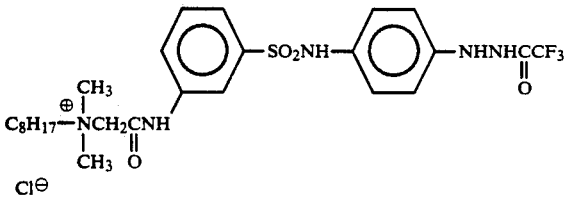
8
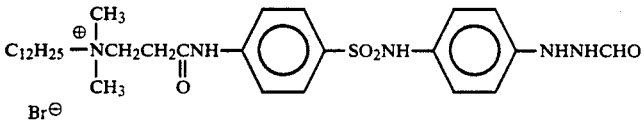
9
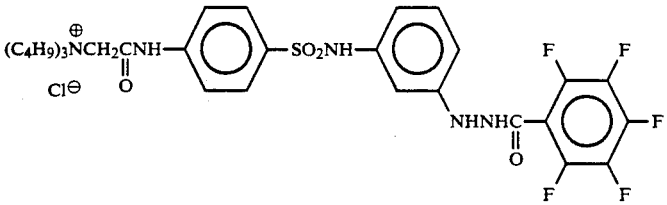
10
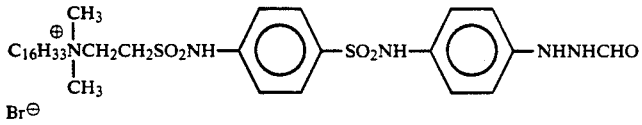
11
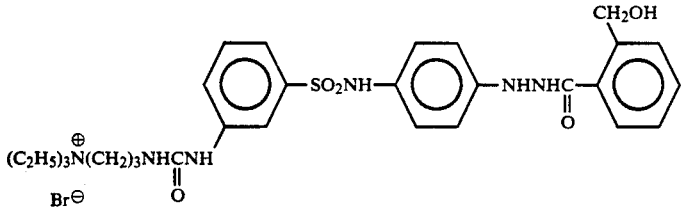
12
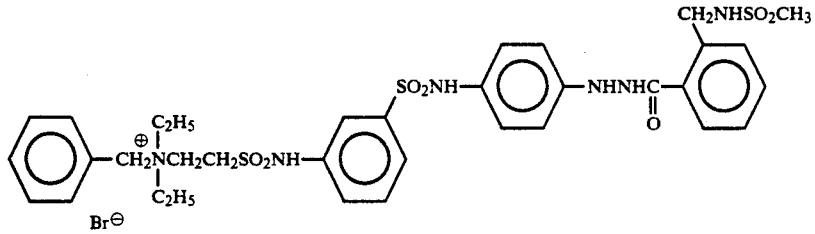
13
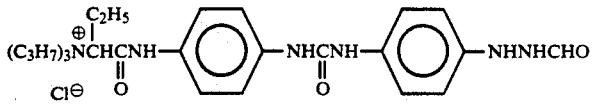

-continued
14
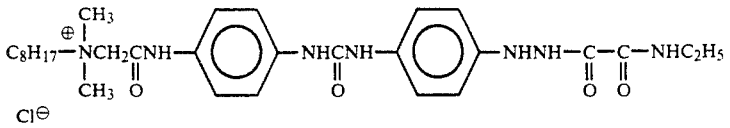
15
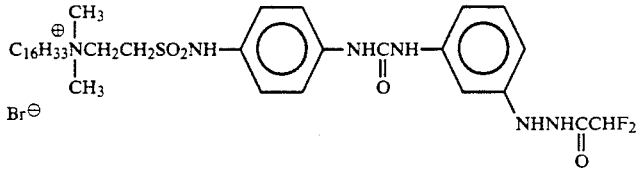
16
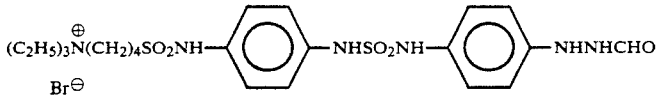
17
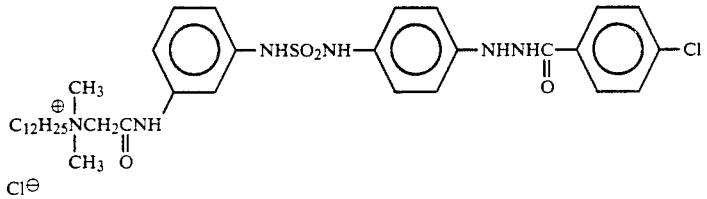
18
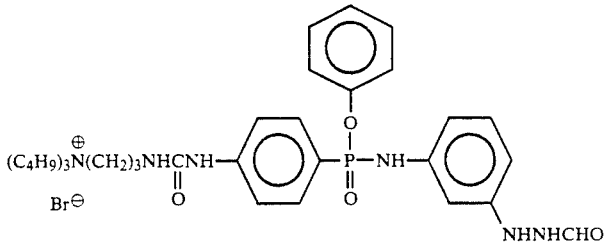
19
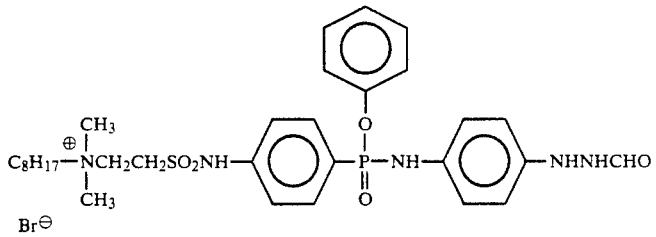
20
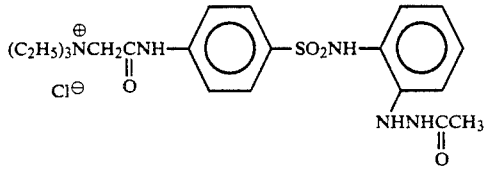
21
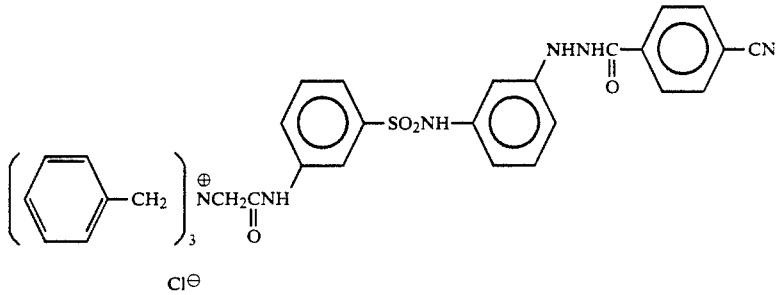

-continued

22

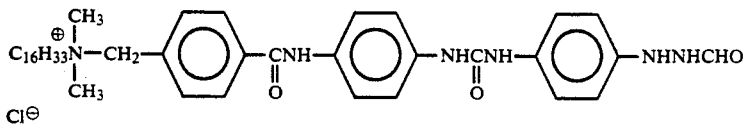

23

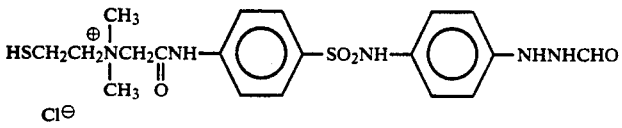

24

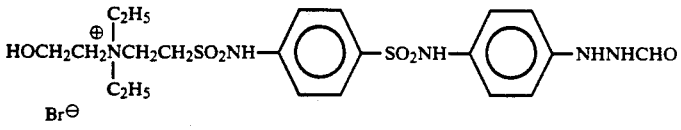

25

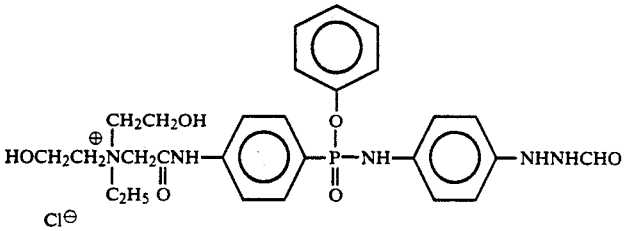

26

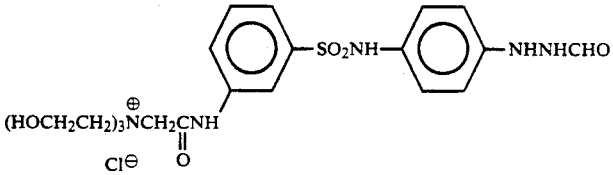

27

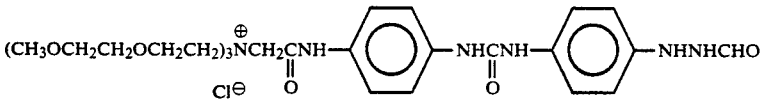

28

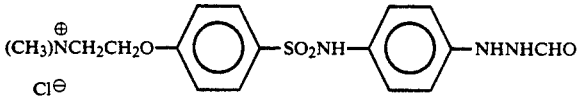

29

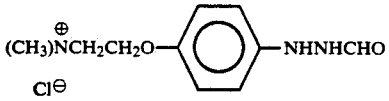

The hydrazine compound according to the present invention can be synthesized by utilizing the processes disclosed, e.g., in JP-A-61-213847, JP-A-62-260153, U.S. Pat. No. 4,684,604, JP-A-1-269936, U.S. Pat. Nos. 3,379,529, 3,620,746, 4,377,634, and 4,332,878, JP-A-49-129536, JP-A-56-153336, JP-A-56-153342, and U.S. Pat. Nos. 4,988,604 and 4,994,365. A typical synthesis example is given below.

SYNTHESIS EXAMPLE

Synthesis of Compound 6

To a solution of 11.5 g of a compound having formula:

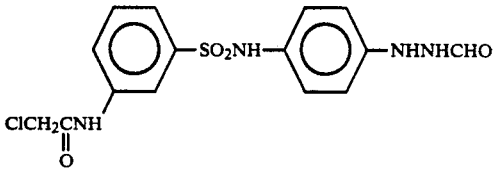

in 30 ml of dimethylacetamide was added 16.7 ml of triethylamine, and the mixture was stirred at 80° to 90° C. for 6 hours in a nitrogen atmosphere. After completion of the reaction, 80 ml of methyl alcohol was added thereto, and the mixture was poured into 1 l of ethyl acetate. The white solid thus precipitated was collected by filtration. The solid was again dissolved in methyl alcohol and recrystallized from ethyl acetate to obtain 12.0 g of Compound 6. Identification of the resulting compound was made by the NMR spectrum and IR spectrum.

The hydrazine compound (I) is used as dissolved in an appropriate water-miscible organic solvent, such as an alcohol (e.g., methyl alcohol, ethyl alcohol, propyl alcohol or a fluorinated alcohol), a ketone (e.g., acetone or methyl ethyl ketone), dimethylformamide, dimethyl sulfoxide, methyl cellosolve, etc.

The hydrazine compound (I) may also be used in the form of an emulsified dispersion prepared by a well-known dispersion method using an oil (e.g., dibutyl phthalate, tricresyl phosphate, glyceryl triacetate or diethyl phthalate) and an auxiliary solvent (e.g., ethyl acetate or cyclohexanone). It is also possible to use the hydrazine compound (I) as a dispersion prepared by a well-known solid dispersion method in which a powdered compound is dispersed in water in a ball mill, a colloid mill, etc. or by ultrasonic waves.

The hydrazine compound (I) is preferably used in an amount ranging from $1.0\times10^{-6}$ to $5\times10^{-2}$ mole, and preferably from $1.0\times10^{-5}$ to $2\times10^{-2}$ mole, per mole of silver halide.

The compound (I) is preferably incorporated into a silver halide emulsion layer but may be incorporated into other light-insensitive hydrophilic colloidal layers, such as a protective layer, an intermediate layer, a filter layer, an antihalation layer, and the like. Where it is added to a silver halide emulsion layer, the addition may be effected at any arbitrary stage of from the start of chemical ripening and before coating. The compound (I) is preferably added after completion of chemical ripening and before coating, and more preferably added to a coating composition to be coated.

The silver halide emulsion which can be used in the present invention may have any halogen composition, such as silver chloride, silver chlorobromide, silver iodobromide, and silver iodochlorobromide. In the case of light-sensitive materials for dot-to-dot work, silver halide grains comprising at least 60 mol %, and particularly 75 mol % or more, of silver chloride are preferred. In the case of light-sensitive materials for dot formation work, silver halide grains comprising at least 70 mol %, and particularly 90 mol % or more, of silver bromide with a silver iodide content being not more than 10 mol %, and particularly from 0.1 to 5 mol %, are preferred.

Fine silver halide grains (e.g., having a mean grain size of 0.7 μm or less) are preferred in the present invention. A particularly preferred mean grain size is 0.5 μm or less. Grain size distribution is not essentially limited, but a mono-dispersion is preferred. The terminology "mono-dispersion" as used herein means a dispersion in which at least 95% of the weight or number of grains fall within a size range of ±40% of a mean grain size.

Silver halide grains in a photographic emulsion may have a regular crystal form, such as a cubic form and an octahedral form, or an irregular crystal form, such as a spherical form and a plate-like form, or a composite form of these crystal forms. Cubic grains are particularly preferred.

Individual silver halide grains may have a uniform phase or different phases between the inside and the surface layer thereof. Two or more different silver halide emulsions separately prepared may be used as a mixture.

During silver halide grain formation or physical ripening of grains, a cadmium salt, a sulfite salt, a lead salt, a thallium salt, a rhodium salt or a complex thereof, an iridium salt or a complex thereof, etc. may be present in the system. Suitable rhodium salts include rhodium monochloride, rhodium dichloride, rhodium trichloride, ammonium hexachlororhodate and, for preference, water-soluble halogeno-complex compounds of trivalent rhodium, e.g., hexachlororhodic (III) acid or salts thereof (e.g., ammonium salt, sodium salt or potassium salt). The water-soluble rhodium salt is usually added in an amount of from $1.0\times10^{-8}$ to $1.0\times10^{-3}$ mol, and preferably from $1.0\times10^{-7}$ to $5.0\times10^{31\ 4}$ mol, per mol of silver halide.

The silver halide emulsion which can be used in the present invention may or may not be chemically sensitized. Chemical sensitization of a silver halide emulsion is carried out by sulfur sensitization, reduction sensitization, noble metal sensitization, or combination thereof.

Among the noble metal sensitization techniques, typical is gold sensitization using a gold compound, usually a gold complex. Complexes of noble metals other than gold, e.g., platinum, palladium and iridium, may also be employed. Specific examples of these noble metal compounds are described in U.S. Pat. No. 2,448,060 and British Patent 618,016.

Sulfur sensitization is effected by using a sulfur compound contained in gelatin as well as various sulfur compounds, e.g., thiosulfates, thioureas, thiazoles, and rhodanines.

Reduction sensitization is carried out by using a reducing compound, e.g., stannous salts, amines, formamidinesulfinic acid, and silane compounds.

The silver halide emulsion layers may further contain known spectral sensitizing dyes. Useful sensitizing dyes, combination of dyes exhibiting supersensitization, and substances showing supersensitization are disclosed in *Research Disclosure*, Vol. 176, No. 17643, p. 23, IV-J (Dec., 1978).

Binders or protective colloids which can be used in the silver halide emulsions include gelatin to advantage. Hydrophilic colloids other than gelatin may also be employable, including proteins, e.g., gelatin derivatives, graft polymers of gelatin and other high polymers, albumin, and casein; cellulose derivatives, e.g., hydroxyethyl cellulose, carboxymethyl cellulose, and cellulose sulfate; sugar derivatives, e.g., sodium alginate and starch derivatives; and a variety of synthetic hydrophilic high polymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole, as well as copolymers comprising monomers constituting these homopolymers.

Gelatin to be used includes lime-processed gelatin, acid-processed gelatin, hydrolysis products of gelatin, and enzymatic decomposition products of gelatin.

For prevention of fog during preparation, preservation or photographic processing of the light-sensitive material or for stabilization of photographic properties, various compounds can be introduced into the light-sensitive material of the present invention. Such compounds include azoles, such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, and nitrobenzotriazoles, mercaptopyrimidines; mercaptotriazines; thioketo compounds, such as oxazolinethione, azaindenes, such as triazaindenes, tetraazaindenes (especially 4-hydroxy-sutstituted (1,3,3*a*,7)-tetraazaindenes), and pentaazaindenes; hydroquinone and derivatives thereof; disulfides, such as thioctic acid; benzenethiosulfonic acids, benzenesulfinic acids, benzenesulfonic acid amides, and many other compounds known as antifoggants or stabilizers. Preferred of them are benzotriazoles (e.g., 5-methylbenzotriazole) and nitroindazoles (e.g., 5-nitroindazole). If desired, these compounds may be added to a processing solution.

The light-sensitive materials of the present invention may contain an organic desensitizer containing at least one water-soluble or alkali-dissociating group. Suitable organic desensitizers are illustrated in JP-A-63-64039. The organic desensitizer is usually added to a silver halide emulsion layer in an amount of from $1.0\times10^{-8}$ to $1.0\times10^{-4}$ mol/m$^2$, and preferably of from $1.0\times10^{-7}$ to $1.0\times10^{-5}$ mol/m$^2$.

The light-sensitive materials of the present invention may contain a development accelerator or a nucleation infectious development accelerator. Examples of effective development accelerators or nucleation infectious development accelerators are disclosed in JP-A-53-77616, JP-A-54-37732, JP-A-53-137133, JP-A-60-140340, and JP-A-60-14959 as well as various compounds containing a nitrogen or sulfur atom.

Specific examples of these development accelerators are shown below.

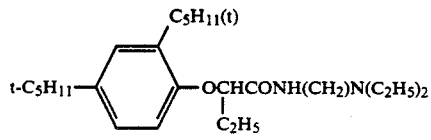

(1)

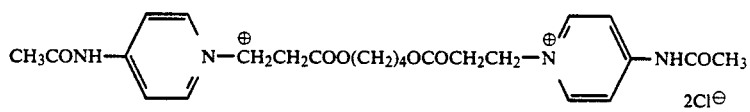

(2)

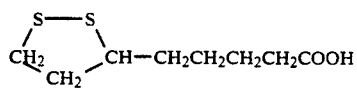

(3)

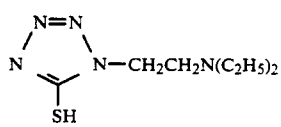

(4)

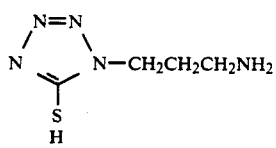

(5)

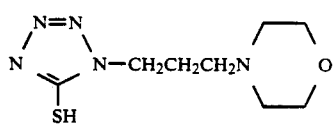

(6)

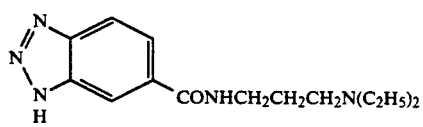

(7)

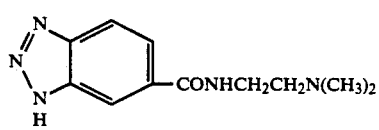

(8)

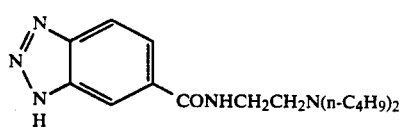

(9)

-continued

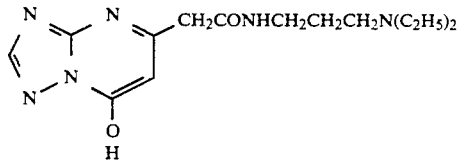

(10)

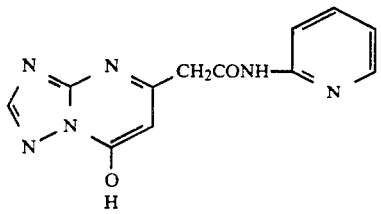

(11)

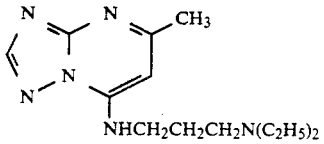

(12)

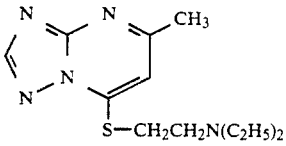

(13)

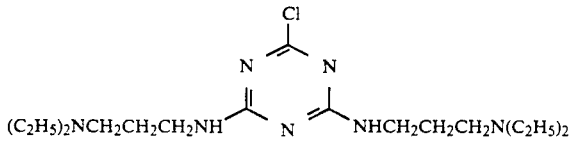

(14)

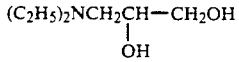

(15)

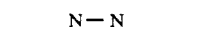

(16)

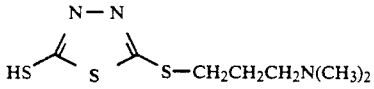

(17)

The development accelerator is used in an amount usually of from $1.0\times10^{-3}$ to 0.5 g/m$^2$, and preferably from $5.0\times10^{-3}$ to 0.1 g/m$^2$, although the optimum amount varies depending on the kind of the compound. The development accelerator can be incorporated into a coating composition as dissolved in an appropriate solvent, e.g., water, alcohols (e.g., methyl alcohol and ethyl alcohol), acetone, dimethylformamide, and methyl cellosolve.

The above-mentioned additives may be used either individually or in combination of two or more thereof.

The emulsion layers or other hydrophilic colloidal layers of the light-sensitive material according to the present invention may contain a water-soluble dye as a filter dye or an anti-irradiation dye or for various other purposes. Filter dyes to be used include those for reducing photographic sensitivity, preferably ultraviolet absorbents having a spectral absorption maximum in the intrinsic sensitivity region of silver halide and those for improving safety against safelight in handling of light-sensitive materials for bright room, i.e., dyes showing substantial light absorption in the region chiefly in the range of from 310 to 600 nm.

According to the purpose, these dyes are preferably added to an emulsion layer or fixed in a light-insensitive hydrophilic colloidal layer farther from a support than a silver halide emulsion layer by using a mordant. The dyes are added in an amount usually of from $1\times10^{-3}$ to 1 g/m$^2$, and preferably of from 10 to 500 mg/m$^2$, through varying depending on the molar absorption coefficient of the dye.

The above-mentioned dyes are added to a coating composition for a light-sensitive and/or light-insensitive hydrophilic colloidal layer in the form of a solution in an appropriate solvent, e.g., water, an alcohol (e.g., methyl alcohol, ethyl alcohol, or propyl alcohol), acetone, methyl cellosolve or a mixture thereof.

These dyes may be used either individually or in combination of two or more thereof.

Specific examples of suitable dyes are described in JP-A-63-64039.

In addition, ultraviolet absorbing dyes described in U.S. Pat. Nos. 3,533,794, 3,314,794, and 3,352,681, JP- A-46-2784, U.S. Pat Nos. 3,705,805, 3,707,375, 4,045,229, 3,700,455, and 3,499,762, and West German Patent Publication 1,547,863, pyrazolone oxonol dyes described in U.S. Pat. No. 2,274,782, diaryl azo dyes described in U.S. Pat. No. 2,956,879, styryl dyes or butadienyl dyes described in U.S. Pat. Nos. 3,423,207 and 3,384,487, merocyanine dyes described in U.S. Pat. No. 2,527,583, merocyanine dyes or oxonol dyes described in U.S. Pat. Nos. 3,486,897, 3,652,284, and 3,718,472, enaminochemioxonol dyes described in U.S. Pat. No. 3,976,661, and other dyes described in British Patents 584,609 and 1,177,429, JP-A-48-8513-, JP-A-49-99620, JP-A-49-114420, and U.S. Pat. Nos. 2,533,472, 3,148,187, 3,177,078, 3,247,127, 3,540,887, 3,575,704, and 3,653,905 may also be employed.

The silver halide emulsion layers or other hydrophilic colloidal layers may contain an organic or inorganic hardening agent, such as chromates (e.g., chromium alum and chromium acetate), aldehydes (e.g., formaldehyde, glyoxal, and glutaraldehyde), N-methylol compounds (e.g., dimethylolurea and methyloldimethylhydantoin), dioxane derivatives (e.g., 2,3-dihydroxydioxane), active vinyl compounds (e.g., 1,3,5-triacryloyl-hexahydro-s-triazine and 1,3-vinylsulfonyl-2-propanol), active halogen compounds (e.g., 2,4-dichloro-6-hydroxy-s-triazine), and mucohalogenic acids (e.g., mucochloric acid and mucophenoxychloric acid), epoxy compounds (e.g., tetramethylene glycol diglycidyl ether), and isocyanate compounds (e.g., hexamethylene diisocyanate), either individually or in combination thereof.

High polymeric hardening agents described in JP-A-56-66841, British Patent 1,322,971, and U.S. Pat. No. 3,671,256 can also be used.

The silver halide emulsion layers or other hydrophilic colloidal layers may further contain various surface active agents for the purpose of coating aid, static charge prevention, improvement of slip properties, emulsification and dispersion aid, prevention of blocking, and improvement of photographic characteristics (e.g., acceleration of development, increase of contrast, and increase of sensitivity).

Useful surface active agents include nonionic surface active agents, such as saponin (steroid type), alkylene oxide derivatives (e.g., polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, polyethylene oxide adducts of silicone), glycidol derivatives (e.g., alkenylsuccinic acid polyglycerides, and alkylphenol polyglycerides), fatty acid esters of polyhydric alcohols, and alkyl esters of saccharides; anionic surface active agents containing an acid radical, e.g., a carboxyl group, a sulfo group, a phospho group, a sulfuric ester group, and a phosphoric ester group, such as alkylcarboxylates, alkylsulfonates, alkylbenzenesulfonates, alkylnaphthalenesulfonates, alkylsulfates, alkyl phosphates, N-acyl-N-alkyltaurines, sulfosuccinic esters, sulfoalkyl polyoxyethylene alkylphenyl ethers, and polyoxyethylene alkylphosphates; amphoteric surface active agents, such as amino acids, aminoalkylsulfonic acids, aminoalkylsulfates or phosphates, alkylbetaines and amine oxides; and cationic surface active agents, such as alkylamines, aliphatic or aromatic quaternary ammonium salts, heterocyclic quaternary ammonium salts, e.g., pyridinium salts, and imidazolium salts, and phosphonium or sulfonium salts containing an aliphatic or heterocyclic ring.

Surface active agents which are particularly useful in the present invention are polyalkylene oxides having a molecular weight of 600 or more as disclosed in JP-B-58-9412 (the term "JP-B" as used herein means an "examined published Japanese patent application "). For purpose of improving dimensional stability, polymer latices, such as polyalkyl acrylates, may be used.

The silver halide light-sensitive material of the present invention can be processed with a stable developing solution to obtain ultrahigh contrast characteristics. There is no need to use conventional infectious developers or highly alkaline developers having a pH of nearly 13 as described in U.S. Pat. No. 2,419,975.

More specifically, a negative image having sufficiently high contrast can be obtained by processing the silver halide light-sensitive material of the present invention with a developing solution containing 0.15 mol/l or more of a sulfite ion as a preservative and having a pH between 10.5 and 12.3, particularly between 11.0 and 12.0.

A developing agent which can be used in the developing solution is not particularly restricted. For example, dihydroxybenzenes (e.g., hydroquinone), 3-pyrazolidones (e.g., 1-phenyl-3-pyrazolidone and 4,4-dimethyl-1-phenyl-3pyrazolidone), and aminophenols (e.g., N-methyl-p-aminophenol) are used either alone or in combinations thereof.

A combination of a dihydroxybenzene as a main developing agent and a 3-pyrazolidone or an aminophenol as an auxiliary developing agent is particularly suitable for development of the light-sensitive material of the present invention. In this type of a developing solution, the dihydroxybenzene is preferably used in an amount of from 0.05 to 0.5 mol/l, and the 3-pyrazolidone or aminophenol is preferably used in an amount of not more than 0.06 mol/l.

Addition of an amine compound to a developing solution is effective to increase the rate of development thereby to shorten the time of development as suggested in U.S. Pat. No. 4,269,929.

The developing solution may further contain a pH buffering agent (e.g., the compounds described in JP-A-60-93433 and JP-A-62-186259, a development inhabitor (e.g., a bromide and an iodide), and an organic antifoggant (nitroindazoles or benzotriazoles are particularly preferred). If desired, the developing solution may furthermore contain a water softener, a dissolution aid (e.g., the compounds disclosed in JP-A-61-267759), a toning agents, a development accelerator, a surface active agent (the above-described polyalkylene oxides are particularly preferred), a defoaming agent, a hardening agent, a silver stain inhibitor (e.g., the compounds disclosed in JP-A-56-24347, e.g., 2-mercaptobenzimidazolesulfonic acids), and so on.

A fixing solution which can be used for processing may have any known composition. Usable fixing agents include thiosulfates, thiocyanates, and organic sulfur compounds known to be effective as a fixing agent. The fixing solution may contain a water-soluble aluminum salt, etc. as a hardening agent.

The processing temperature usually ranges from 18° to 50° C.

Photographic processing of the light-sensitive material of the present invention is desirably carried out by means of an automatic developing machine. The light-sensitive material according to the present invention provides a negative image having sufficiently high contrast even when rapidly processed in an overall processing time (the time of from entering an automatic developing machine through withdrawal) of from 90 seconds to 120 seconds.

The present invention is now illustrated in greater detail by way of Examples, but it should be understood that the present invention is not deemed to be limited thereto. All the percents, parts, and ratios are by weight unless otherwise indicated.

EXAMPLE 1

1) Preparation of Light-Sensitive Emulsion

A silver nitrate aqueous solution and a sodium chloride aqueous solution were simultaneously added to a gelatin aqueous solution kept at 40° C. in the presence of $5.0\times10^{-6}$ mol of $NH_4RhCl_6$ per mol of silver. After soluble salts were removed by a well-known method, gelatin was added to the emulsion. To the primitive emulsion was added 2-methyl-4-hydroxy-1,3,3*a*,7-tetraazaindene as a stabilizer to obtain a mono-dispersed emulsion of cubic grains having a mean grain size of 0.2 μm.

To the thus prepared emulsion was added each of the hydrazine compounds (I) and comparative compounds shown in Table 1 below in the amount shown. To the emulsion was further added 15 mg/m² of a nucleation acceleration having formula:

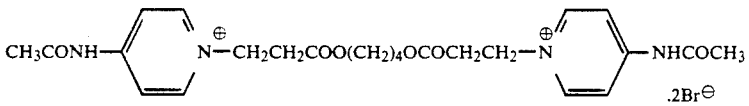

To the emulsion were furthermore added a polyethyl acrylate latex in an amount of 30% (solid basis) based on gelatin and 1,3-divinylsulfonyl-2-propanol as a hardening agent.

2) Preparation of Sample

The resulting coating composition was coated on a polyester film to a silver coverage of 3.8 g/m² (gelatin coverage: 1.8 g/m²).

A composition comprising 1.5 g/m² of gelatin and 0.3 g/m² of polymethyl methacrylate particles having a particle size of 2.5 μm was coated on the silver halide emulsion layer to form a protective layer.

3) Processing

The resulting sample for dot-to-dot work was imagewise exposed to light through the original shown in FIG. 1 of JP-A-2-293736 using a bright room printer "P-627 FM" manufactured by Dainippon Screen Mfg. Co., Ltd., developed with Developing Solution A having the formulation shown below at 38° C. for 20 seconds in an automatic developing machine "FG 710 NH" manufactured by Fuji Photo Film Co., Ltd., fixed with a fixing solution "GR-F 1" produced by Fuji Photo Film Co., Ltd., washed with water, and dried.

| Formulation of Developing Solution A: | |
|---|---|
| Hydroquinone | 50.0 g |
| N-Methyl-p-aminophenol | 0.3 g |
| Sodium hydroxide | 18.0 g |
| Potassium hydroxide | 55.0 g |
| 5-Sulfosalicylic acid | 45.0 g |
| Potassium sulfite | 110.0 g |
| Disodium ethylenediaminetetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole)benzenesulfonate | 0.2 g |
| N-n-Butyldiethanolamine | 15.0 g |
| Sodium toluenesulfonate | 8.0 g |
| Water to make | 1 l |
| pH (adjusted with potassium hydroxide) = 11.6 | |

4) Evaluation of Photographic Properties

Super-imposed letter image quality and $D_{max}$ of each of the processes samples were evaluated as follows, and the results obtained are shown in Table 1.

The light-sensitive material for dot-to-dot work was exposed under proper conditions so that a dot area of 50% of the original might be reproduced on the light-sensitive material as a dot area of 50%. When letters having a line width of 30 μm could be reproduced as super-imposed letters, the image quality was rated "5" (best quality). On the other hand, when only letters having a line width of 150 μm or more were reproduced, such image quality was rated "1" (worst quality). Image quality between "5" and "1" was dividedly rated "4", "3", and "2" by visual observation. Image quality levels rated "3" or higher are acceptable for practical use.

$D_{max}$ is a maximum density of the sample exposed in the same manner as described above.

It can be seen from the results shown in Table 1 that the samples according to the present invention exhibit high $D_{max}$ and excellent super-imposed letter image quality.

TABLE 1

| Sample No. | Hydrazine Compound Kind | Hydrazine Compound Amount (mol/mol-Ag) | $D_{max}$ | Super-Imposed Letter Image Quality | Remark |
|---|---|---|---|---|---|
| 1-a | Compound A | $1.5\times10^{-3}$ | 3.3 | 4 | Comparison |
| 1-b | Conpound B | " | 3.2 | 3 | " |
| 1-c | Compound C | " | 2.9 | 3 | " |
| 1-1 | Compound 6 | " | 3.7 | 5 | Invention |
| 1-2 | Compound 7 | " | 3.6 | 5 | " |
| 1-3 | Compound 9 | " | 3.5 | 5 | " |
| 1-4 | Compound 21 | " | 3.4 | 5 | " |
| 1-5 | Compound 23 | " | 3.6 | 5 | " |
| 1-6 | Compound 26 | " | 3.5 | 5 | " |

Compound A:

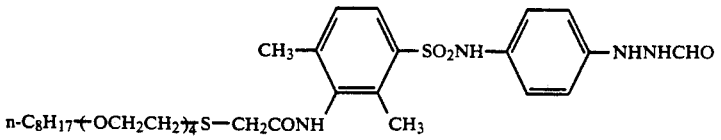

(Compound I-6 of U.S. Pat. 4,988,604)

Compound B:

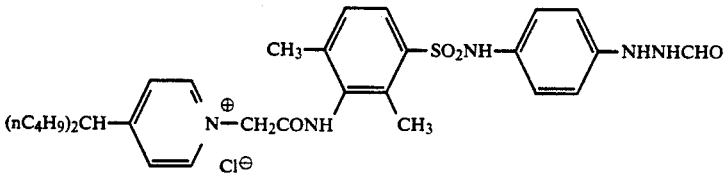

(Compound I-6 of U.S. Pat. 4,994,365)

Compound C:

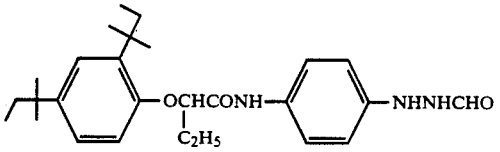

Then, Developing Solution A was put in the same automatic developing machine as used above, and the machine was run at 38° C. for 8 hours a day without passing films. After 5-day running, the sample was processed with the thus air-fatigued developing solution, and the photographic properties of the processed sample were evaluated in the same manner as described above. The results obtained are shown in Table 2 below. In Table 2, ΔD is a difference between the $D_{max}$ of Table 1 and that of Table 2. It is seen that the samples according to the present invention undergo less variation in $D_{max}$.

TABLE 2

| Sample No. | $D_{max}$ | $\Delta D_{max}$ | Super-imposed Letter Image Quality |
|---|---|---|---|
| 1-a | 2.5 | −0.8 | 5 |
| 1-b | 2.6 | −0.6 | 4 |
| 1-c | 2.5 | −0.4 | 4 |
| 1-1 | 3.6 | −0.1 | 5 |
| 1-2 | 3.5 | −0.1 | 5 |
| 1-3 | 3.3 | −0.2 | 5 |
| 1-4 | 3.2 | −0.2 | 5 |
| 1-5 | 3.5 | −0.1 | 5 |
| 1-6 | 3.3 | −0.2 | 5 |

EXAMPLE 2

1) Preparation of Light-Sensitive Emulsion

A silver nitrate aqueous solution and a mixed aqueous solution of potassium iodide and potassium bromide were simultaneously added to a gelatin aqueous solution kept at 50° C. for 60 minutes in the presence of $4\times10^{-7}$ mol/mol-Ag of potassium hexachloroiridate (III) and ammonia while maintaining a pAg at 7.8 to prepare a mono-dispersed emulsion of cubic silver halide grains having a mean grain size of 0.28 μm and an average silver iodide content of 0.3 mol%. After the emulsion was desalted by a flocculation method, 40 g/mol-Ag of inert gelatin was added thereto. 5,5'-Dichloropotassium iodide were added to the emulsion while maintaining at 50° C. After allowing the emulsion to stand for 15 minutes, the temperature was decreased.

2) Coating of Light-Sensitive Emulsion Layer

The above prepared emulsion was re-melted, and each of the hydrazine compounds shown in Table 3 below was added thereto at 40° C. Further, 5-methylbenzotriazole, 4-hydroxy-1,3,3*a*,7-tetraazaindene, 3.5 mg/m² of compounds (a) shown below, 15.0 mg/m² of compound (b) shown below, 30% of polyethyl acrylate based on gelatin, and 2.0% of compound (c) shown below (gelatin hardening agent) based on gelatin were added to the emulstion to prepare a coating composition:

A 150 μm-thick polyethylene terephthalate film having a 0.5 μm-thick subbing layer comprising a vinylidene chloride copolymer was coated with the coating composition to a silver coverage of 3.8 g/m².

Compound (a):

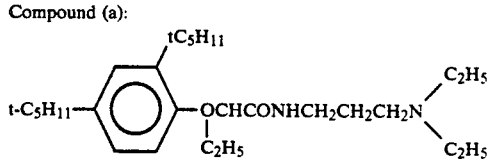

Compound (b):

-continued

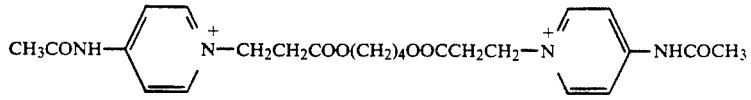

Compound (c):

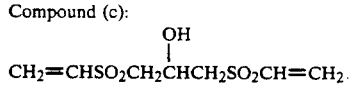

3) Coating of Protective Layer

A coating composition having the following formulation was coated on the emulsion layer to form a protective layer.

| | |
|---|---|
| Gelatin | 1.5 g/m$^2$ |
| Polymethyl methacrylate particles (average particle size: 2.5 μm) | 0.3 g/m$^2$ |
| Fine silver chloride particles (mean grain size: 0.08 μm) | 0.3 g-Ag/m$^2$ |
| Surface active agents: | |
| 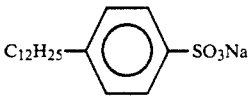 | 37 mg/m$^2$ |
| $CH_2COOC_6H_{13}$ \| $CHCOOC_6H_{13}$ \| $SO_3Na$ | 37 mg/m$^2$ |
| $C_8F_{17}SO_2N(C_3H_7)CH_2COOK$ | 2.5 mg/m$^2$ |

4) Processing

Each of the resulting samples was exposed to tungsten light of 3200° K. through an optical wedge and a contact screen ("150L Chain Dot Type" produced by Fuji Photo Film Co., Ltd.), developed with Developing Solution B having the following formulation at 34° C. for 30 seconds, fixed, washed, and dried.

| Formulation of Developing Solution B: | |
|---|---|
| Hydroquinone | 50.0 g |
| N-Methyl-p-aminophenol | 0.3 g |
| Sodium hydroxide | 18.0 g |
| Potassium hydroxide | 20.0 g |
| Potassium sulfite | 30.0 g |
| Disodium ethylenediaminetetraacetate | 1.0 g |
| Potassium bromide | 10.0 g |
| 5-Methylbenzotriazole | 0.4 g |
| 2-Mercaptobenzimidazole-5-sulfonic acid | 0.3 g |

-continued

| Formulation of Developing Solution B: | |
|---|---|
| Sodium 3-(5-mercaptotetrazole)benzenesulfonate | 0.2 g |
| N-n-Butyldiethanolamine | 7.0 g |
| Sodium toluenesulfonate | 8.0 g |
| Water to make | 1 l |
| pH | adjusted to 10.7 |

5) Evaluation of Photographic Properties

Each of the processed samples was evaluated as follows. The results obtained are shown in Table 3.

Dot quality was visually evaluated and rated "5" (best quality), "4" (acceptable for practical use), "3" (lowest limit for practical use), "2" (unacceptable for practical use), or "1" (worst quality). $D_{max}$ is an optical density at an exposure amount ($0.5+\log E_3$) larger than the exposure amount providing a density of 1.5 ($\log E_3$) by 0.5.

It is seen from Table 3 that the hydrazine compounds according to the present invention provide high dot quality while retaining a high $D_{max}$.

TABLE 3

| Sample No. | Hydrazine Compound Kind | Amount (mol/mol-Ag) | $D_{max}$ | Dot Image Quality | Remark |
|---|---|---|---|---|---|
| 2-a | Compound A | $0.8 \times 10^{-3}$ | 2.2 | 3 | Comparison |
| 2-b | Compound B | " | 2.0 | 2 | " |
| 2-c | Compound C | " | 1.7 | 2 | " |
| 2-1 | Compound 6 | " | 4.1 | 5 | Invention |
| 2-2 | Compound 7 | " | 4.0 | 5 | " |
| 2-3 | Compound 9 | " | 3.9 | 4 | " |
| 2-4 | Compound 21 | " | 3.8 | 4 | " |
| 2-5 | Compound 23 | " | 3.9 | 5 | " |
| 2-6 | Compound 26 | " | 3.8 | 4 | " |

While the invention has been described in detail and with reference to specific examples thereof, it will be apparent to one skilled in the art that various changes and modifications can be made therein without departing from the spirit and scope thereof.

What is claimed is:

1. A silver halide light-sensitive material comprising a support and a silver halide emulsion layer and containing a compound represented by formula (I):

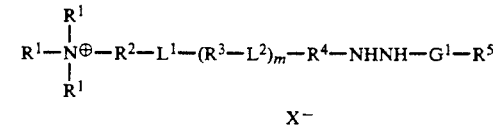

(I)

wherein $L^1$ represents a single bond, —O—, —S—, —$NR^6$—, —CO—, $SO_2$—, —P(O) ($G^2R^6$)— or a combination thereof; $L^2$ represents —$SO_2NR^6$—, —$NR^6SO_2NR^6$—, —$CONR^6$—, —$NR^6CONR^6$— or —$G^2R^6)NR^6$—; $G^1$ represents —CO—, —$SO_2$—, —SO—, —COCO—, a thiocarbonyl group, an iminomethylene group or —P(O) ($G^2R^6$)—; $G^2$ represents a single bond, —O— or —$NR^6$—; $R^1$ represents an aliphatic group or an aromatic group; $R^2$, $R^3$, and $R^4$ each represent a divalent aliphatic group or a divalent aromatic group; $R^5$ represents a hydrogen atom, an aliphatic group, an aromatic group, an alkoxy group, an aryloxy group or an amino group; $R^6$ represents a hydrogen atom, an aliphatic group or an aromatic group; m represents 0 or 1; and $X^-$ represents a counter anion or a counter anion moiety of an intramolecular salt.

2. The silver halide light-sensitive material as in claim 1, wherein said aliphatic group for $R^1$ is an alkyl group having from 1 to 20 carbon atoms, and said aromatic group for $R^1$ is a monocyclic or bicyclic aryl group, or an unsaturated heterocyclic group.

3. The silver halide light-sensitive material as in claim 1, wherein said divalent aliphatic group for $R^2$, $R^3$ or $R^4$ is an alkylene group having from 1 to 20 carbon atoms, and said divalent aromatic group for $R^2$, $R^3$ or $R^4$ is a monocyclic or bicyclic arylene group, or an unsaturated divalent heterocyclic group.

4. The silver halide light-sensitive material as in claim 1, wherein said $L^1$ represents —$SO_2NR^6$—, —$NR^6SO_2NR^6$—, —$CONR^6$—, —$NR^6CONR^6$—, or —$G^2$(P)O($G^2R^6$)$NR^6$—.

5. The silver halide light-sensitive material as in claim 1, wherein said aliphatic group for $R^5$ is an alkyl group having from 1 to 4 carbon atoms, and said aromatic group for $R^5$ is a monocyclic or bicyclic aryl group.

6. The silver halide light-sensitive material as in claim 1, wherein said $G^1$ represents —CO—.

7. The silver halide light-sensitive material as in claim 1, wherein said compound of formula (I) is contained in an amount of from $1.0\times10^{-6}$ to $5\times10^{-2}$ mole per mole of silver halide.

8. The silver halide light-sensitive material as in claim 7, wherein said compound of formula (I) is contained in an amount of from $1.0\times10^{-5}$ to $2\times10^{-2}$ mole per mole of silver halide.

9. The silver halide light-sensitive material as in claim 1, wherein said compound of formula (I) is incorporated into the silver halide emulsion layer.

10. The silver halide light-sensitive material as in claim 1, wherein silver halide grains of the silver halide emulsion layer are silver chloride, silver chlorobromide, silver iodobromide or silver iodochlorobromide.

11. The silver halide light-sensitive material as in claim 10, wherein said silver halide grains comprise at least 60 mol% of silver chloride.

12. The silver halide light-sensitive material as in claim 10, wherein said silver halide grains comprise at least 70 mol% of silver bromide with a silver iodide content being not more than 10 mol%.

13. The silver halide light-sensitive material as in claim 10, wherein said silver halide grins have a mean grain size of 0.7 μm or less.

* * * * *